United States Patent [19]

Pernicano et al.

[11] 4,071,139

[45] Jan. 31, 1978

[54] PACKAGED SHIRT WITH RECORD ALBUM STIFFENER

[75] Inventors: Vincent S. Pernicano, Boyne Falls; Michael R. Wright, Detroit, both of Mich.

[73] Assignee: Art-On Designs, Inc., Ferndale, Mich.

[21] Appl. No.: 661,936

[22] Filed: Feb. 27, 1976

[51] Int. Cl.[2] ..... B65D 85/18; B65D 85/30

[52] U.S. Cl. ..... 206/216; 206/281; 206/292; 206/311; 229/87 S

[58] Field of Search ..... 206/45.33, 216, 278, 206/281, 292–293, 297, 309, 311, 459, 491–492, 494–495, 525, 527; 223/66, 71, 84; 229/87 S, 87 A

[56] References Cited

U.S. PATENT DOCUMENTS

| | | | |
|---|---|---|---|
| 1,826,206 | 10/1931 | Farrelly | 229/87 S |
| 1,880,027 | 9/1932 | Small | 229/87 S |
| 2,204,419 | 6/1940 | Lighter | 229/87 S |
| 2,636,312 | 4/1953 | Martin | 206/216 X |
| 2,884,124 | 4/1959 | Abbey | 206/297 X |
| 3,414,175 | 12/1968 | Brosk | 206/278 X |
| 3,430,761 | 3/1969 | Pelkey | 206/309 |
| 3,463,303 | 8/1969 | Gorman et al. | 206/309 X |
| 3,891,129 | 6/1975 | Knappe et al. | 229/87 S X |

FOREIGN PATENT DOCUMENTS

| | | | |
|---|---|---|---|
| 1,229,688 | 9/1960 | France | 229/87 S |
| 1,507,294 | 11/1967 | France | 206/281 |

*Primary Examiner*—Steven E. Lipman
*Attorney, Agent, or Firm*—McGlynn and Milton

[57] ABSTRACT

A packaged T-shirt assembly is disclosed. A T-shirt with a design disposed on its front portion is placed against a glass top panel of a rectangular positioning box which has a fluorescent light therein. The rays of fluorescent light shine through the top panel and through the front and back portions of the shirt to isolate the design. The shirt is then moved so that the design is centered within the outer periphery of the top panel. A flat stiffener, such as a record album assembly or piece of packaging cardboard, is then placed over the back portion of the shirt. The side sections of the shirt are then folded around the edges of the stiffener and, thereafter, the bottom and top sections of the shirt are folded over or atop the side sections. Tape strips are used to secure the side sections to the back surface of the stiffener and the top and bottom sections together. A wrapper of transparent material is then disposed around the assembly to enclose the shirt and stiffener.

3 Claims, 7 Drawing Figures

PACKAGED SHIRT WITH RECORD ALBUM STIFFENER

BACKGROUND OF THE INVENTION

This invention relates to packaged shirts and methods of packaging shirts.

Many individuals collect T-shirts with artistic or ornate designs thereon. Since T-shirts are relatively inexpensive as compared to other types of shirts, T-shirt enthusiasts often collect tens and even hundreds of such T-shirts with various designs disposed on the T-shirts. In order to expose these enthusiasts to the greatest number of T-shirts with various different designs, it is desirable to package the T-shirts in a fashion which will not only enable the viewer to see the entire design but also expose the viewer to the greatest number of different designs.

Presently, articles of clothing such as sweaters or shirts, which include front and back portions, are positioned in front of a piece of cardboard and the sleeves and side portions of the article are folded behind the carboard while the lower portion of the article is folded upward behind the cardboard. The top portion of the garment is not, however, folded behind the cardboard and the neck opening between the shoulders of the garment is open on the front of the cardboard so that an inside label positioned within the neck opening is within view of the perspective buyer of the garment. As a result of such packaging the cardboard may be removed without unfolding the shirt.

By practicing the subject invention, it is possible to package T-shirts in a compact and easily handled fashion thereby to present the design formed on the T-shirts in a favorable light and also in a way that will facilitate the viewing of these packaged T-shirts. Furthermore, these packaged T-shirts may be stored or maintained on store shelves in much the same way as record albums are now stored in an upright position.

In accordance with the subject invention, there is provided a packaged shirt assembly comprising a stiffener means having at least three interconnected stiff corners spaced apart from each other, the corners defining a display area. A shirt is provided with a design disposed on the shirt, the shirt being disposed about the corners in a predetermined position with the shirt folded around the outer periphery of the display area. Also included are securing means for securing the shirt about the stiffener means in the predetermined position for displaying the design on the packaged shirt.

The subject invention also provides a method of packaging a shirt having front and back portions defining a body cavity with a design disposed on the front portion by positioning the shirt so that the front portion thereof faces a bounded area of light of sufficient brightness to shine through the front and back portions and isolate the position of the design, and thereafter moving the front and back portions of the shirt within the area of light to position the design relative to the area of light.

Other advantages of the present invention will be readily appreciated as the same becomes better understood by reference to the following detailed description when considered in connection with the accompanying drawings wherein.

Figure 6:
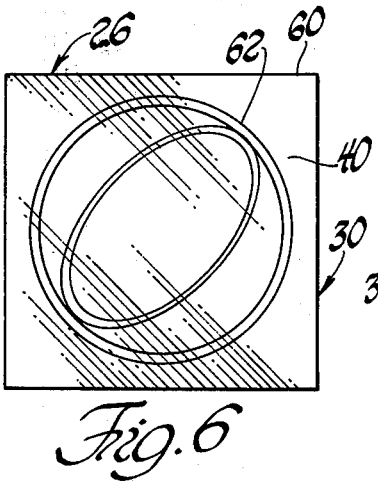
Figure 7:
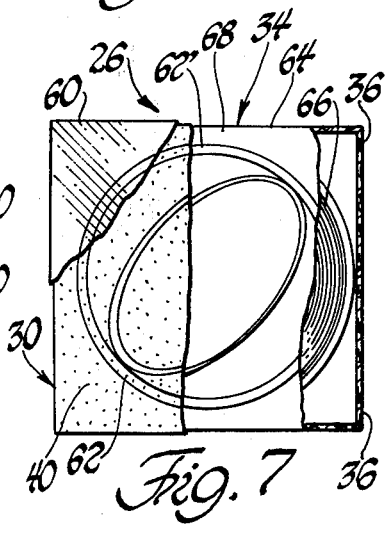

FIG. 6 is a plan view of the packaged shirt assembly of the subject invention showing the design formed on the front portion of the shirt and the packaged shirt enclosed in a wrapper of transparent material; and FIG. 7 is a view like FIG. 6 but partially broken away and in cross section to show the different layers which make up one embodiment of the packaged shirt assembly of the subject invention.

DESCRIPTION OF THE PREFERRED EMBODIMENT

Figure 1:
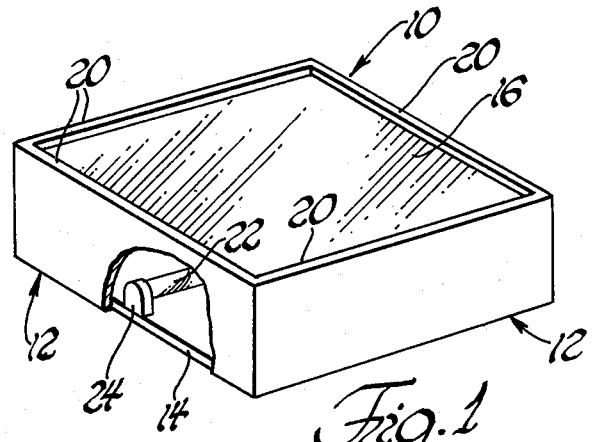
FIG. 1 is a perspective view of a shirt positioning box, partially broken away and in cross section.

Referring now to the drawings, a light-emitting positioning box is generally shown at 10 in FIG. 1. The positioning box 10 generally comprises a six-sided rectangular box. The six sides include side walls 12 and a bottom panel 14, the side walls 12 and the bottom panel 14 being made of materials of an opaque substance such as wood, metal or plastic, etc. The top or sixth side of the positioning box 10 comprises a transparent substance, for example, this sixth side may comprise a glass or clear plastic square top panel 16. The top panel 16 rests on shoulders 18 formed about the inner periphery of the side walls 12 a predetermined distance from top edges 20 of the side walls 12.

A fluorescent lamp 22 is positioned interiorly the positioning box 10 between brackets 24 fixedly mounted on the bottom panel 14. When the fluorescent lamp 22 is electrically energized in a well-known fashion, the rays of light from the fluorescent lamp 22 are directed towards the top panel 16 between the opaque side walls 12. This bounded area of light has a predetermined brightness determined by the electrical characteristics of the fluorescent lamp and the extent to which the fluorescent lamp 22 is energized.

Figure 2:
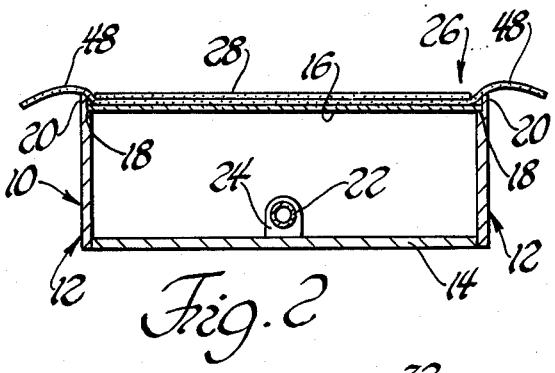
FIG. 2 is a cross-sectional view of the positioning box of FIG. 1 and further showing a T-shirt and a stiffening means disposed thereon.

A shirt, such as a T-shirt, generally shown at 26 in FIG. 2, is placed within this bounded area of light or, in other words, on the top surface of the top panel 16, the shirt 26 overlapping the top edges 20 of the side walls 12. The shirt 26 has a design formed thereon, the design being adjacent or facing the bounded area of light as defined by the top panel 16. The rays of light from the fluorescent lamp 22 have a brightness sufficient to shine through the shirt 26 thereby isolating, exposing or showing the position of the design disposed on the shirt 26 relative to the top edges 20. The design appears as a shadow to one viewing the shirt 26 from above the positioning box 10. The shirt 26 and thereby the design is then moved to a predetermined position within the area of light. For example, the design formed on the shirt 26 may be centered on the top panel 16. Thereafter, a flat, square, stiffening means, such as a sheet of packaging cardboard 28 is placed atop or over the shirt 26. The stiffening means is disposed below and retained in position by the top edges 20 of the side walls 12 prior to folding the shirt over the stiffening means 28. The sheet of packaging cardboard 28 has an outer periphery which is of less length than the outer periphery of the shirt 26 so that the shirt 26 may be folded over the side edges of the piece of packaging cardboard 28 after the packaging cardboard 28 is properly centered atop the shirt 26.

Figure 3:
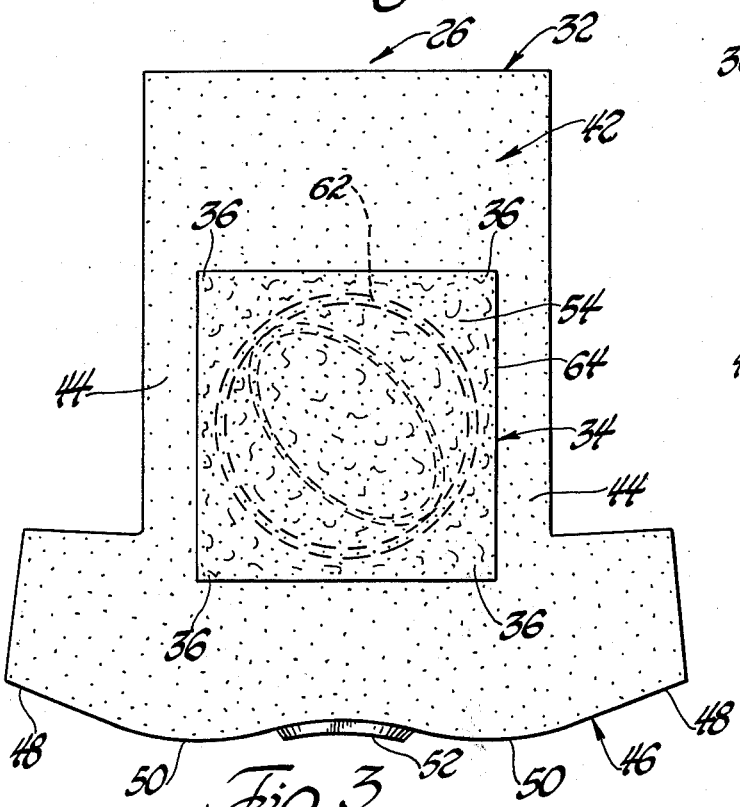
FIG. 3 is a plan view showing a T-shirt with a design disposed thereon and a stiffener means, both disposed on the positioning box in a pre-folded position.
Figure 4:
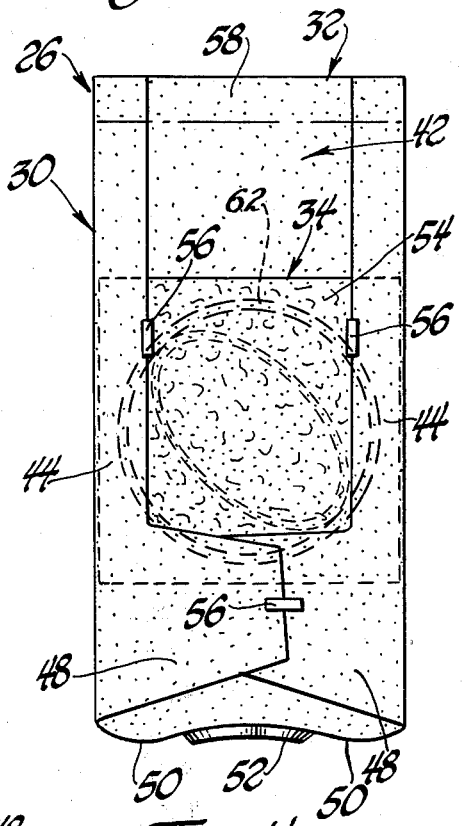
FIG. 4 is a view similar to FIG. 3 but showing the T-shirt in a first folded position.

As illustrated in FIGS. 3 and 4, the shirt 26 has front and back portions generally indicated at 30 and 32 respectively. The front portion 30 has a design formed thereon as seen in phantom in FIG. 3 or as seen in FIG. 6. The stiffener means may comprise a flat square cardboard sheet as mentioned above, or a record album assembly, as generally indicated at 34. In either case the stiffener means is positioned atop or over the back portion 32 of the shirt 26. The record album assembly 34 has at least three and preferably four interconnected and spaced-apart stiff corners 36. The corners 36 generally define a display area or, in other words, if lines are drawn interconnecting the corners 36 those lines which define the outer periphery of the drawn geometric figure also define the display area, within which area the design is displayed.

The front and back portions 30 and 32 respectively of the shirt 26 define an interior body cavity (not shown) but the record album assembly 34 is disposed exteriorly of the body cavity.

The shirt 26 also has central sections 40 of the front portion 30 which covers the display area as shown in FIGS. 6 and 7, bottom sections generally indicated at 42, two side sections 44 and top sections generally indicated at 46, it being understood that each of the front and back portions 30 and 32 include at least one of each of these sections. The top sections 46 define sleeves 48, shoulders 50 and a neck opening 52 between the shoulders 46.

Figure 5:
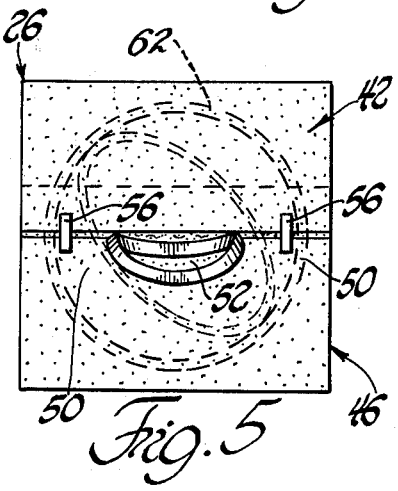
FIG. 5 is a view similar to FIG. 4 but showing the T-shirt fully folded about the stiffener means and secured in that position.

As shown in FIG. 4, the side sections 44 are folded over the side edges of the record album assembly 34 and are secured in position or to the back surface 54 of the record album assembly 34 by securing means. The securing means includes a plurality of tape strips 56, two of which secure the side sections 44 to the back surface 54 of the record album assembly 34. The sleeves 48 are folded behind the record album assembly 34 and the sleeves 48 are secured together by a tape strip 56. The bottom sections 42 and the top sections 46 are then folded over or above the side sections 44, one of the strips 56 securing the bottom sections 42 to the shoulders 50 of the top sections 46, as shown in FIG. 5. The neck opening 52 is therefore open at the back surface 54 of the record album assembly 34.

Because the bottom sections 32 are longer than the top sections 46 as folded, the bottommost extremities 58 of the bottom sections 42 are folded over the side sections 44 before the remainder of the bottom sections 42 are folded over the side edge of the record album assembly 34. This is done to prevent the bottom sections 42 and the top sections 46 from overlapping at the back surface 54 of the record album assembly 34 which would make the packaged T-shirt bulky.

The securing means further includes a wrapper 60 of transparent material such as cellophane which is disposed about and completely encloses the shirt 26 by shrink wrapping as shown in FIG. 6. The wrapper 60 allows the design 62 formed on the body portion 40 of the front portion 30 to be viewed and at the same time protects the shirt 26 from being soiled.

In FIG. 7, the entire packaged shirt assembly is shown in layers. The first layer is the transparent wrap or wrapper 60. The second layer is the central section 40 with the design 62 disposed thereon. The third layer is the record album assembly 34 which includes a record album container 64 which too has a design 62' disposed thereon which is responsive to the design 62 disposed on the central section 40. The designs 62 and 62' are responsive to one another in that they are identical, similar, complimentary or relate to one another in any other manner. The record album assembly 34 also includes a record 66 which defines the fourth layer as shown in FIG. 7. As shown in FIG. 7, the design 62' is disposed on the front surface 68 of the container 64.

Thus, the invention includes a method of packaging a shirt of the type having front and back portions 30 and 32 defining a body cavity with a design 62 disposed on the front portion 30 including the steps of positioning the shirt 26 so that the front portion 30 faces a bounded area of light, as defined by the top panel 16, which light is of sufficient brightness to shine through the front and back portions 30 and 32 and isolate the position of the design 62 and moving the front and back portions 30 and 32 of the shirt 26 over the top panel 16 defining the light area to position the design 62 centrally relative to the light area defined by the top panel 16. Thereafter the additional steps of placing a stiffening means, such as the cardboard sheet 28 or the record album assembly 34, over the back portion 32 in a predetermined position relative to the design 62 and securing the shirt in position relative to the stiffening means with the tape strips 56, the stiffening means is placed within the confines of the back portion 32 so that top, bottom and side sections 46, 42 and 44 respectively, extend from the periphery of the stiffening means. These sections 42, 44 and 46 are folded about the periphery of the stiffening means and onto the rear or back surface 54 of the stiffening means so that the design 62 is displayed over the front of the stiffening means. In so folding, the side sections 44 are first folded and then the top and bottom sections 46 and 42 are folded over and atop the side sections 44.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

The embodiments of the invention in which an exclusive property or privilege is claimed are defined as follows:

1. A packaged shirt assembly comprising: stiffener means having at least three interconnected stiff corners spaced apart from each other, said corners defining a display area, a shirt, a design disposed on said shirt, said shirt being disposed about said corners in a predetermined position with said shirt folded around the outer periphery of said display area and said design displayed over said display area, and securing means for securing said shirt about said stiffener means in said predetermined position, said shirt including front and back portions which coact to define an interior body cavity, said stiffening means being disposed exteriorly of said body cavity and said design being exteriorly of and on said front portion, said front and back portions including central sections covering said display area, said design being disposed on said central section of said front portion, said stiffener means including front and back surfaces extending between peripheral edges with said central sections extending over said front surfact, said stiffener means being defined by a record album assembly including a record album container and a record disposed within said container.

2. An assembly as defined in claim 1 wherein said front surface is defined by said record album container and includes a design thereon responsive to said design disposed on said shirt.

3. An assembly as set forth in claim 2 wherein said securing means includes a wrapper of transparent material disposed around and enclosing said shirt and said stiffener means.

* * * * *